US005678951A

United States Patent [19]

Levasseur

[11] Patent Number: 5,678,951

[45] Date of Patent: Oct. 21, 1997

[54] ELEMENT FOR SYNTHETIC TENNIS GROUND AND METHOD FOR ITS PRODUCTION

[75] Inventor: Francois Levasseur, Saint-Denis, France

[73] Assignee: Sommer Levasseur, Nanterre Cedex, France

[21] Appl. No.: 492,130

[22] PCT Filed: Jan. 27, 1994

[86] PCT No.: PCT/EP94/00235

§ 371 Date: Sep. 18, 1995

§ 102(e) Date: Sep. 18, 1995

[87] PCT Pub. No.: WO94/18393

PCT Pub. Date: Aug. 18, 1994

[30] Foreign Application Priority Data

Feb. 12, 1993 [FR] France ..... 93 870025

[51] Int. Cl.[6] ..... E21C 13/00; E21C 13/06; E21C 13/08

[52] U.S. Cl. ..... 404/17; 404/82; 428/17

[58] Field of Search ..... 404/17, 18, 82; 428/17; 52/177, 181

[56] References Cited

U.S. PATENT DOCUMENTS

| | | | |
|---|---|---|---|
| 4,044,179 | 8/1977 | Haas, Jr. | 428/17 |
| 4,336,286 | 6/1982 | Tomarin | 428/17 |
| 4,337,283 | 6/1982 | Haas, Jr. | 428/17 |
| 4,396,653 | 8/1983 | Tomarin | 428/17 |
| 4,444,815 | 4/1984 | Friedrich | 428/17 |
| 4,705,706 | 11/1987 | Avery | 428/17 |
| 4,735,825 | 4/1988 | Friedrich | 428/17 X |
| 5,320,447 | 6/1994 | Ubero | 404/17 X |

FOREIGN PATENT DOCUMENTS

| | | | |
|---|---|---|---|
| 174755 | 3/1986 | European Pat. Off. | 428/17 |
| 0 263 566 | 4/1988 | European Pat. Off. . | |
| 37 03 866 | 8/1988 | Germany . | |
| 2246077 | 1/1992 | United Kingdom | 428/17 |
| 89/09306 | 10/1989 | WIPO . | |

*Primary Examiner*—George A. Suchfield
*Attorney, Agent, or Firm*—Sheridan Ross P.C.

[57] ABSTRACT

An element suitable for building permanent tennis courts and repairing existing clay courts, comprising a structured textile support forming an open-structured mat and consisting of rot-proof synthetic fibres, which is filled with a first layer essentially consisting of sand with a particle size suitable for drainage, and a second surface layer consisting of ground brick with a smaller particle size than the underlying layer.

17 Claims, 1 Drawing Sheet

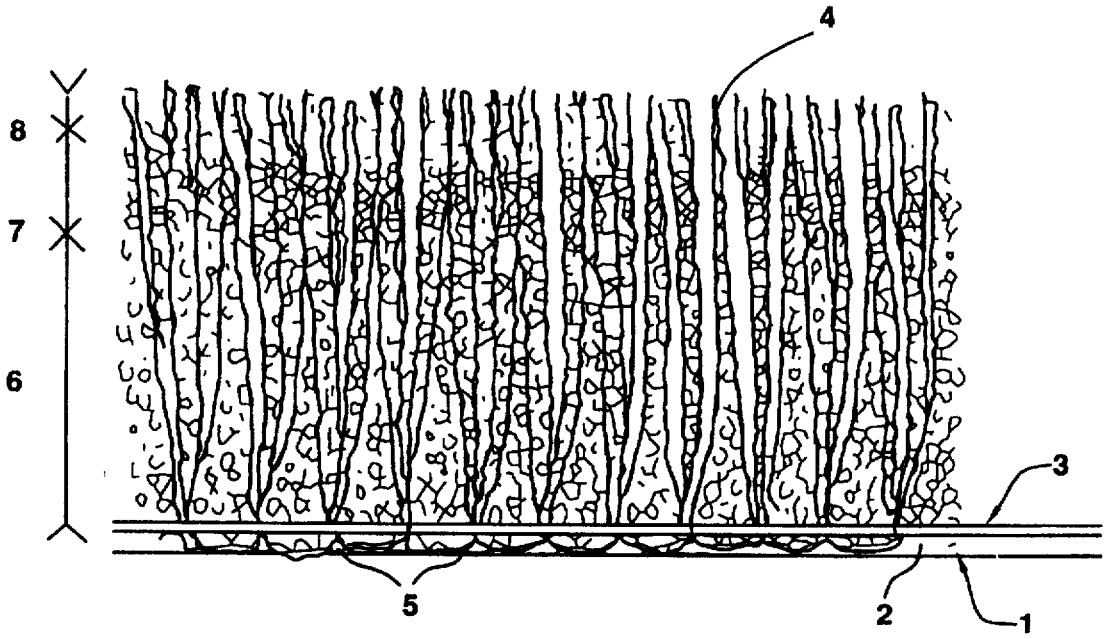
4
8
7
6
3
5
2
1

ELEMENT FOR SYNTHETIC TENNIS GROUND AND METHOD FOR ITS PRODUCTION

SUBJECT OF THE INVENTION

The present invention relates to an element making it possible to produce a synthetic tennis ground similar to clay-surface (crushed brick) grounds, more particularly allowing the playing of tennis outdoors.

The invention also extends to a method for producing such a ground.

The invention relates, in practice, to a construction of permanent clay-surface tennis courts and to the reconditioning of old tennis courts, in particular tennis courts made of porous concrete or any other hard surface.

TECHNOLOGICAL BACKGROUND

Currently, the construction of a so-called "clay-surface" tennis surface involves the laying of at least three successive layers of constituent elements.

First of all, it is necessary to arrange a foundation layer which will constitute the solid base of the system, capable of supporting the loads and having the requisite flatness properties. This is more generally compacted gravel.

The second layer consists of a chalk layer or a layer of an equivalent material, which is provided particularly to ensure good drainage, as well as for flexibility in playing.

Finally, a red cover layer is produced, which is generally obtained from finely powdered crushed brick.

Finally, the playing lines are drawn generally by painting or by laying prefabricated plastic lines.

This type of surface, called "clay-surface", has become traditional for the playing of tennis outdoors.

The major advantage of a surface of this type is the playing comfort which protects the muscles and the joints of the player. This comfort results, on the one hand, from the flexibility in depth which allows damping of the vertical impact of the foot during running and, on the other hand, from the controlled sliding of the tennis shoe over the surface, which avoids jarring of the foot in its horizontal movements.

However, this conventional construction of clay-surface playing surfaces has two fundamental drawbacks:

First of all, in the event of freezing, the water suspended in the intermediate layer (generally a chalk layer) freezes and causes the chalk/clay-surface complex to expand. During unfreezing, the whole subsides, losing any cohesion, and the playing lines are destroyed. Because of this, the surface is unusable and requires reconditioning, which can be undertaken only when the risk of freezing has ended. This results in several months of unavailability of the ground.

Another drawback is observed in the event of heavy rain, when the chalk/clay-surface complex no longer provides sufficiently fast drainage. In fact, this surface is greatly weakened when it is too wet and this necessarily results in a waiting time before it can be used after heavy rain.

SUMMARY OF THE STATE OF THE ART

It is known to produce "artificial turf" intended for football, hockey or tennis grounds, which consists in particular of tufted or needled products.

Several documents, and in particular documents EP-A-263,566, U.S. Pat. No. 4,044,179, U.S. Pat. No. 4,396,653 and DE-A-3,703,866, describe embodiments of such artificial turf. In all these documents, it is proposed to add one or more layers of sand in order to improve the properties, in particular of bounce, of this artificial turf. In most of the documents, it is proposed to arrange two layers of sand with different particle sizes successively in the tufted product.

In document WO-A-8,909,306 it is proposed to add granules of elastomer materials in products of this type, in order both to improve the drainage properties and to avoid the formation of ice.

In general, all these coverings leave part of the elements constituting the tufted or needled product (bristles, thin strips, etc.) open to the air.

OBJECTS OF THE PRESENT INVENTION

The present invention aims to provide, in particular, an element suitable both for the construction of permanent clay-surface tennis courts and for reconditioning such tennis courts, even on a concrete support or on any hard surface, which avoids the drawbacks in particular mentioned above due to ice and to heavy rain.

A complementary object of the invention is to provide a product having the same playing comfort as traditional products.

Finally, the solution provided by the invention also makes it possible, in the long term, to avoid significant costs linked with renovation or reconditioning which is necessary with conventional grounds, both as regards the support surface and the playing lines.

BRIEF DESCRIPTION OF THE DRAWING

The FIGURE is a schematic sectional view of a particular embodiment of the structure or element of the present invention.

MAIN CHARACTERISTIC ELEMENTS OF THE INVENTION

The present invention relates to an element suitable for the construction of permanent tennis courts and for reconditioning old tennis courts including a structured textile support forming an open-structured carpet and composed of anti-rot synthetic fibres into which support are successively filled a first layer essentially consisting of sand and having a particle size ensuring suitable draining and a second surface layer consisting of crushed brick having a particle size less than the particle size of the underlying layer.

Preferably, the height of the second crushed-brick layer lies between 1/5 and 1/10 of the total height of the complex comprising the two layers of sand and crushed brick.

The height of the textile fibres constituting the open-structured carpet advantageously lies between 18 and 25 mm, preferably between 20 and 23 mm, in order to provide the complex with sufficient vertical stability. Preferably, the textile fibres are made of polypropylene.

Advantageously, use is made of a loose-structured tufted product combined with a perforated base which preferably consists of a support made of cloth impregnated with a layer of latex.

In practice, a carpet of this type is laid on a suitable base structure, for example compacted gravel, but also, in the case of reconditioning of a concrete tennis court, on a base of conventional concrete, preferably levelled off and regenerated on the surface.

A first layer, essentially of sand, is loaded into the textile support to a height such that a gap of the order of 3 mm is left with respect to the upper surface of the carpet.

According to a preferred embodiment, a first sublayer of sand having a particle size of 0.2/2.8 mm is filled into a tufted product, for example 23 mm in height, over a height of approximately 15 mm, and a second sublayer of sand having a particle size of 0.2/0.3 mm is filled over a height of approximately 5 mm.

The particle size of the first sublayer of sand is chosen so as to ensure both good penetration into the carpet and its complete permeability, while the particle size of the second sublayer is chosen to that it can act as a base for the subsequent layer of crushed brick.

The layer of crushed brick is then laid over a height of approximately 3 mm so as to fill the gap remaining at the surface of the textile support.

After this surface is produced, the whole is compacted by means conventionally used for preparing clay-surface tennis grounds.

The use of the traditional surface material constituted by crushed brick makes it possible to obtain a non-freezing complex having flexibility properties comparable with traditional products.

It should be noted that the profile, that is to say the surface appearance of the sand used, is selected to avoid damage to the textile fibres of the carpet. Round-edged shapes both allow this damage to be avoided and ensure excellent permeability.

This permeability is further reinforced by the existence of holes pierced in sufficient numbers in the base of the latex-covered textile support.

The use of complementary drainage structures arranged below the product of the invention clearly also comes into the present invention.

It should be noted that, in addition to its flexibility and sliding properties, the carpet/sand/clay-surface complex can immediately absorb a significant quantity of water, while waiting for it to infiltrate into the foundation layer. Thus, the layer will be quickly freed of stagnant water and the time for which the ground cannot be used following a rain shower will be reduced.

The quality of bounce of the ball is equivalent to that obtained on traditional clay-surface courts.

The present invention furthermore provides considerable advantages for reconditioning old porous-concrete tennis courts and any hard surfaces on which the product according to the invention can be implemented after reconditioning (levelling, surface finishing and piercing) with a view to making the surface of this foundation layer permeable.

It thus becomes possible to convert worn and old hard surfaces into flexible clay surfaces.

Description of a Particular Embodiment of the Present Invention

The present invention will be described with the aid of a particular embodiment which is represented in the single attached figure.

This figure essentially represents a textile support given the general label 1, consisting of a base comprising a cloth support 3 impregnated with a layer of latex 2 in which fibres 4, made of polypropylene and having a height of approximately 25 mm, are fixed by conventional tufting techniques, and with a relatively loose structure.

The base of the textile support is pierced with openings 5 in order to have suitable draining.

This textile support 1, after having been laid on a plane surface, is filled with a first sublayer of sand 6 having a particle size of 0.2/0.8 mm over a height of 15 mm and then with a second sublayer of sand 7 having a smaller particle size 0.2/0.3 mm over a height of 5 mm.

Finally, the last millimetres are filled using crushed brick 8.

Preferably, a carpet is chosen whose fibres are "clay-surface" coloured, so as to merge with the crushed brick.

The quality of bounce of the balls are also equivalent to those obtained on traditional tennis courts.

As regards the drawing of playing lines, two possibilities can be envisaged for products according to the present invention.

On the one hand, it is envisagable to prepare lines from white carpet, and then insert them along the regulation lines before laying the sand into the carpet. These lines will be made using a textile structure which is much tighter and slightly higher than the adjacent carpet used as textile support, in order to move the general level of the lines by a few millimetres when the whole is covered with a clay surface.

Another possibility consists in preparing lines of profiled plastic and in laying them on the locations of the regulation lines. These plastic profiles have the appearance of tubes having a rectangular cross-section of 50×23 mm and are adhesively bonded onto the textile support before laying the sand.

I claim:

1. A system suitable for the construction of permanent tennis courts and for reconditioning old tennis courts of the clay-surface type, comprising a structured textile support forming an open-structured carpet and composed of anti-rot synthetic fibres into which support are successively filled a first layer consisting essentially of sand and having a particle size ensuring suitable draining and a second surface layer consisting of crushed brick having a particle size less than the particle size of the underlying layer.

2. A system according to claim 1, wherein the second layer has a height lying between ⅕ and 1/10 of the total height.

3. A system according to claim 1, wherein the first layer, consisting essentially of sand, is composed of two sublayers, respectively having a particle size of 0.2/0.8 mm and 0.2/0.3 mm.

4. A system according to claim 1, wherein the textile support consists of a loose-structured rafted product combined with a perforated base.

5. A system according to claim 4, wherein the height of the textile fibres constituting the open-structured carpet lies between 18 and 25 mm and preferably between 20 and 23 mm.

6. A method for producing new permanent tennis courts or reconditioning old tennis courts of the clay-surface type, comprising the steps of laying a structured textile support forming an open-structured carpet composed of anti-rot synthetic fibres on a plane surface, and successively filling the textile support with a first layer consisting essentially of sand, having a particle size ensuring suitable drainage and a second surface layer consisting of crushed brick having a particle size less than the particle size of the underlying layer.

7. A method according to claim 6, wherein the step in which the layer consisting essentially of sand is loaded is broken down into two steps in which a first sublayer consisting of sand having a particle size of 0.2/0.8 mm is filled, and a second sublayer consisting of sand having a particle size of 0.2/0.3 mm is filled.

8. A method according to claim 6 or 7, wherein a plane surface is obtained by compacting earth or gravel in the case of a new construction of permanent tennis courts of the clay-surface type.

9. A method according to claim 6 or 7, wherein a plane surface is obtained by levelling, surface finishing and piercing a concrete base in the case of reconditioning of old tennis courts.

10. A method for using a structured textile support forming an open-structured carpet and composed of anti-rot synthetic fibres to provide a permanent tennis court of the clay-surface type comprising successively loading said structured textile support with a first layer consisting essentially of sand and with a second layer consisting of crushed brick.

11. A system according to claim 2, wherein the first layer, consisting essentially of said, is composed of two sublayers, respectively having a particle size of 0.2/0.8 mm and 0.2/0.3 mm.

12. A system according to claim 11, wherein the textile support consists of a loose-structured tufted product combined with a perforated base.

13. A system according to claim 12, wherein the height of the textile fibres constituting the open-structured carpet lies between 18 and 25 mm and preferably between 20 and 23 mm.

14. A system according to claim 2, wherein the textile support consists of a loose-structured tufted product combined with a perforated base.

15. A system according to claim 14, wherein the height of the textile fibres constituting the open-structured carpet lies between 18 and 25 mm and preferably between 20 and 23 mm.

16. A system according to claim 3, wherein the textile support consists of a loose-structured tufted product combined with a perforated base.

17. A system according to claim 16, wherein the height of the textile fibres constituting the open-structured carpet lies between 18 and 25 mm and preferably between 20 and 23 mm.

* * * * *